US011028619B2

(12) United States Patent
Avganim

(10) Patent No.: US 11,028,619 B2
(45) **Date of Patent: *Jun. 8, 2021**

(54) CORNER-MOUNTED LOCK HEAD FOR COMPUTER SECURITY

(71) Applicant: Meir Avganim, Gealya (IL)

(72) Inventor: Meir Avganim, Gealya (IL)

( * ) Notice: Subject to any disclaimer, the term of this patent is extended or adjusted under 35 U.S.C. 154(b) by 284 days.

This patent is subject to a terminal disclaimer.

(21) Appl. No.: 16/207,808

(22) Filed: Dec. 3, 2018

(65) Prior Publication Data

US 2020/0173201 A1 Jun. 4, 2020

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC ... E05B 73/00; E05B 73/0005; E05B 73/0082
USPC ..... 70/58
See application file for complete search history.

(56) References Cited

U.S. PATENT DOCUMENTS

| | | | | |
|---|---|---|---|---|
| 3,600,912 | A * | 8/1971 | Foreman | E05B 65/0894 70/77 |
| 4,099,397 | A * | 7/1978 | Dauenbaugh | E05B 9/084 70/371 |
| 6,000,251 | A | 12/1999 | Murray, Jr. | |
| 6,058,744 | A | 5/2000 | Ling | |
| 6,463,770 | B1 | 10/2002 | Lee | |
| 6,619,080 | B1 | 9/2003 | Yu | |
| 7,185,518 | B1 | 3/2007 | Huang | |
| 8,833,117 | B2 | 9/2014 | Yang | |
| 9,137,911 | B2 | 9/2015 | Avganim | |
| 9,549,476 | B2 | 1/2017 | Avganim | |
| 9,624,697 | B1 | 4/2017 | Avganim | |
| 9,784,019 | B2 | 10/2017 | Avganim | |
| 2017/0057593 | A1* | 3/2017 | Gray | B62K 27/12 |
| 2017/0314295 | A1* | 11/2017 | Barron | E05B 73/0005 |

FOREIGN PATENT DOCUMENTS

| | | | | |
|---|---|---|---|---|
| GB | 2381825 | * | 6/2003 | E05B 73/00 |

OTHER PUBLICATIONS

International Search Report and Written Opinion dated Nov. 27, 2019 in corresponding PCT International Application No. PCT/IB2019/057084.

* cited by examiner

*Primary Examiner* — Suzanne L Barrett
(74) *Attorney, Agent, or Firm* — Ostrolenk Faber LLP

(57) ABSTRACT

A lock for computer security has housing comprising a bottom wall, at least one side wall and a front wall with a corner region defined adjacent to both the bottom wall and the at least one side wall. A locking assembly comprises a locking assembly body holding at least two locking elements including a main locking element and a movable locking element, both said locking elements being supported by the locking assembly body, and the main locking element extending from and away from the locking assembly body at the front wall of the lock housing. A driver is coupled to the movable locking element, configured to selectively move the movable locking element in frontwise and rearwise directions, and controlled by a locking mechanism. The locking assembly is secured to the housing at the corner region thereof, with the locking elements located directly adjacent both the bottom wall and the at least one side wall.

18 Claims, 19 Drawing Sheets

CORNER-MOUNTED LOCK HEAD FOR COMPUTER SECURITY

BACKGROUND OF THE INVENTION

The present invention is generally directed to locking devices and, more particularly, to extremely miniaturized locking devices, suitable for preventing theft of low profile, very thin electronic devices such as tablets, laptops, mobile communication devices and the like.

The instant inventor and many others have been providing to the industry locking devices and systems for preventing theft of very mobile electronic devices such as tablets, laptops, mobile communication devices and the like for over two decades.

Until recently, the electronic devices that require this protection were still thick enough so that when they rest on a table surface, the well known 3×7 mm security slot, the so-called Kensington slot, was about 5 to 10 mm above the surface on which the electronic device was resting, making it not unduly difficult to use a cylinder lock that uses a T-bar or scissor-action locking elements that can be inserted into the security slot without disturbing the ability of the electronic device to lie flat against its table-top resting surface.

More recently, electronic devices have become so thin, sometimes on the order of only 7 or even fewer millimeters, that the standard security slot is too close to the bottom wall of the electronic device, for example, a mere 3 mm or so above the resting surface, e.g., the table surface, supporting the tablet, laptop, etc.

For more background, applicant incorporates by reference the disclosure in U.S. Pat. No. 6,000,251, which relates to the subject matter of the invention. For example, in FIG. 3 of the '251 patent one can see the T-bar of the locking cylinder which should have a dimension slightly under 3×7 mm. However, the overall cylinder that has a diameter of 21 mm, whereby, this locking cylinder would not be able to be inserted into a security slot that is located within 7 mm of the table surface of mobile device. FIG. 3 of the '251 patent is reproduced herein as prior art FIG. 1*b* and FIG. 26A of the '251 patent is reproduced herein as prior art FIG. 1*a*, in order to provide more background information.

Referring to FIG. 1*a*, as is well known, a security system comprises a lock system 1 with a lock cylinder 12, a cable 14 connected to the body of the lock cylinder 12, the cable terminating in a loop 16 through which the lock cylinder can be threaded to secure the distal end of the cable to an immovable object, e.g., a table, a chair, etc. The lock system 1 has locking elements 120 which fit in a security slot 110 provided in a wall 18 of an electronic device. The locking elements can be operated by a key which is inserted into the keyslot 112.

Referring to prior art FIG. 1*b*, one observes a T-bar style locking pin projecting from a locking cylinder that has a rear lock body 12*a*, a front lock body 12*b*, capped by respective end walls 12*c*, 12*d*, with a cable retainer 12*e* connected/fastened to the lock body 12*a*, at an opening 14*a* for one distal end 14*a* of the cable 14. The locking elements comprise the T-bar 120 having a rotatable tab 120*a*, a shaft 120*b* and a pair of anti-rotation pins 121*a*, 121*b*. When the locking tab 120*a* is inserted into the slot 110 (FIG. 1*a*) and the cylinder key is rotated, the T-bar becomes misaligned and is locked behind the wall 18, all in well known manner.

Still, and as noted above, the miniaturization of electronic devices and particularly, the reduction of their thicknesses to just a few millimeters, and the provision of ever smaller security slots located closer to the resting bottom surface of these electronic devices has made connecting security devices such as those described above with reference to FIGS. 1*a*, 1*b* difficult to accomplish. Moreover, there is an urgent need for locking cylinders that are not only miniaturized, but which also retain their sturdiness, strength and ability to prevent theft.

Several years ago, the instant inventor made a huge contribution to the advancement of the art via his invention of a new style of locking cavity that has become known as the Noble slot or the "wedge slot", and for which he has been granted several patents to date, including U.S. Pat. Nos. 9,137,911; 9,549,476; 9,624,697; and 9,784,019, the contents of which are incorporated by reference herein. The wedge slot utilizes a locking concept quite different from that embodied in the 3×7 mm Kensington slot, in which the locking T-bar element must pass through the slot and lock behind the wall that defines the slot.

The wedge slot, actually a cavity, is formed inside the outer wall of the computer device being secured against theft, so that the locking elements do not penetrate beyond the "slot" as in the prior art and instead become wedged inside the slot/cavity. More specifically, the locking elements become wedged against slanted side walls of the cavity so that any attempt to pull the locking elements actually increases the resistance force against the pulling out force. Comparatively, much smaller, indeed tiny and millimeter sized locking elements are able to provide greater resistance to being pulled or manipulated out of the slot/cavity in the computer device.

SUMMARY OF THE INVENTION

Accordingly, it is an object of the present invention to provide locking elements that are miniaturized compared to prior art locking elements and locking mechanisms.

It is another object of the invention to provide locking elements and mechanisms that more compactly convert rotational motion of a locking cylinder in one plane to rotational motion of a T-bar locking element in a different plane, all without sacrificing strength, usability and sturdiness.

It is also a further object of the invention to provide a security cylinder of the aforementioned type that can be constructed of fewer parts.

The foregoing and other objects of the invention are realized with a lock for computer security that includes: a housing comprising a bottom wall, at least one side wall and a front wall with a corner region defined adjacent to both the bottom wall and the at least one side wall; a locking assembly comprising a locking assembly body holding at least two locking elements including a main locking element and a movable locking element, both said locking elements being supported by the locking assembly body, and the main locking element extending from and away from the locking assembly body at the front wall of the lock housing; a driver coupled to the movable locking element and configured to selectively move the movable locking element in frontwise and rearwise directions; a locking mechanism supported by the housing, coupled to the driver and configured to actuate the drive to move the movable locking element between a locked position and an unlocked position; and the locking assembly being secured to the housing at the corner region thereof, with the locking elements located directly adjacent both the bottom wall and the at least one side wall.

Preferably, the main locking element and the movable locking element, when located adjacent to each other, define a substantially triangle-shape structure and the housing has a cutout at the corner region, at the location of the locking assembly body. Further, the housing surrounds the locking assembly body at the cutout region over more than 180° portion of a circumference associated with the locking assembly body.

Preferably, a retainer made of thin metallic sheet metal that wraps around the locking assembly body and is configured to secure the locking assembly body to the housing by affixing the retainer to the housing. The thickness of the metallic sheet is less than 1 mm. The movable locking element is slideable within a channel formed in the locking assembly body and the movable locking element is mechanically coupled to a driver that is configured to move the movable locking element in the channel formed in the locking assembly body. A locking mechanism is coupled to driver for the movable locking element and is configured to lock the movable locking element in a locked state thereof, at which the locking element is positioned alongside the main locking element. A cable is mechanically coupled to the housing, by which the lock can be tethered to an immovable object.

The retainer has a pair of overlapping tabs and the tabs are physically connected to the housing and the retainer is wrapped around the locking assembly body in a manner that enables the locking assembly body to rotate relative to the retainer and relative to the housing. Preferably, the driver has a circular cross-section and a circular channel in the housing enables the driver to slide back and forth therein. Or, the driver has a rectangular cross-section and including a rectangular channel in the housing for enabling the driver to slide back and forth therein.

Preferably, the main locking element and the movable locking element, when located alongside each other, are associated with a horizontal plane oriented to lie parallel to a bottom horizontal plane passing through bottom surfaces of the locking elements and the plane is located within 2 mm of a flat resting surface on which the housing is located. The height of the horizontal plane remains the same regardless of whether the housing is placed on the resting surface with its bottom side or its at least one side wall contacting the resting surface. The housing is preferably rectangular, defined in part by the bottom wall and by the at least one side wall, for example, the housing has a height dimension and a width dimension, less than 8 mm and 13 mm, respectively.

Other features and advantages of the present invention will become apparent from the following description of the invention which refers to the accompanying drawings.

DETAILED DESCRIPTION OF EMBODIMENTS OF THE INVENTION

Figure 2:
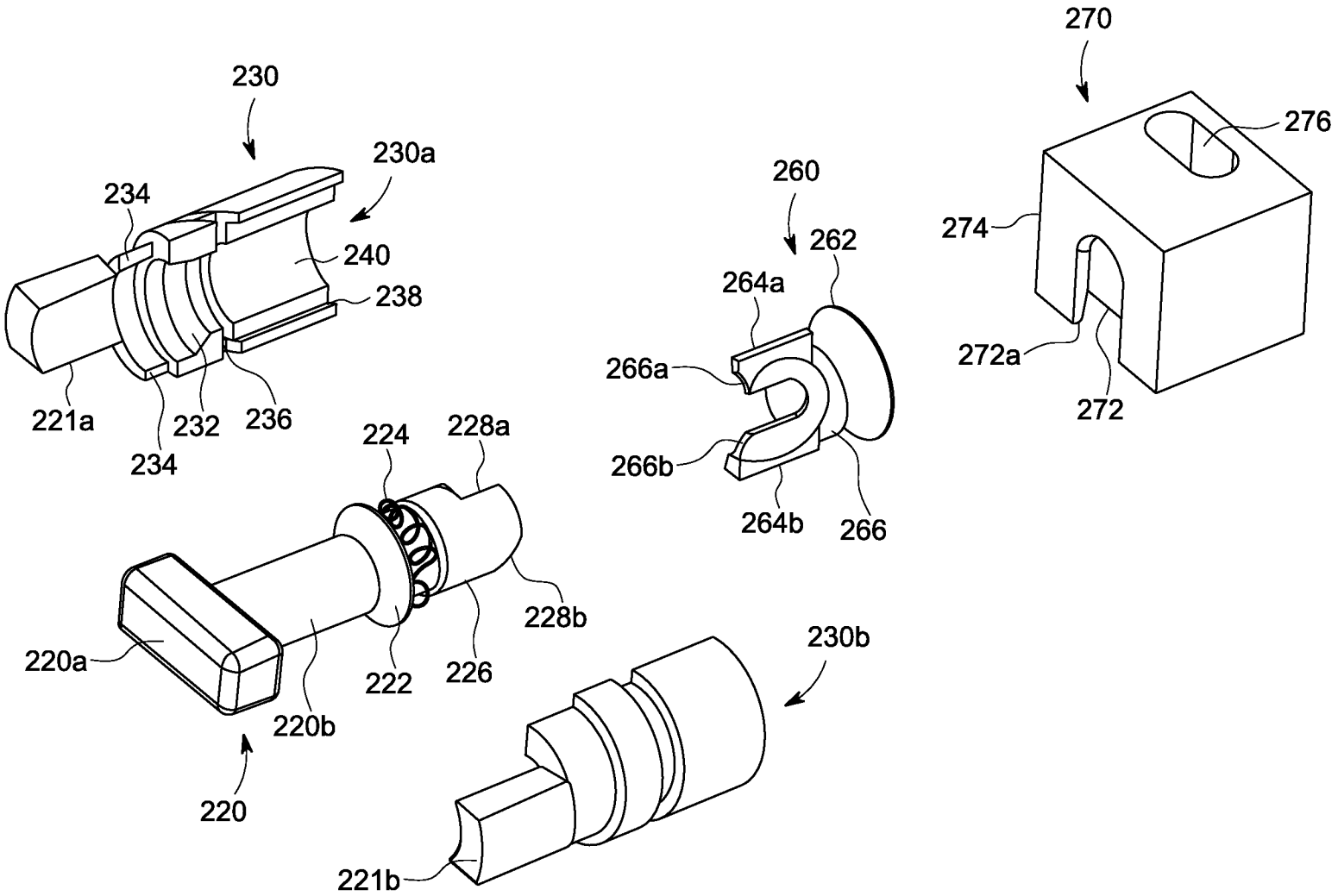
FIG. 2 is an exploded view of the main components of a locking cylinder in accordance with a first embodiment of the present invention.
Figure 3:
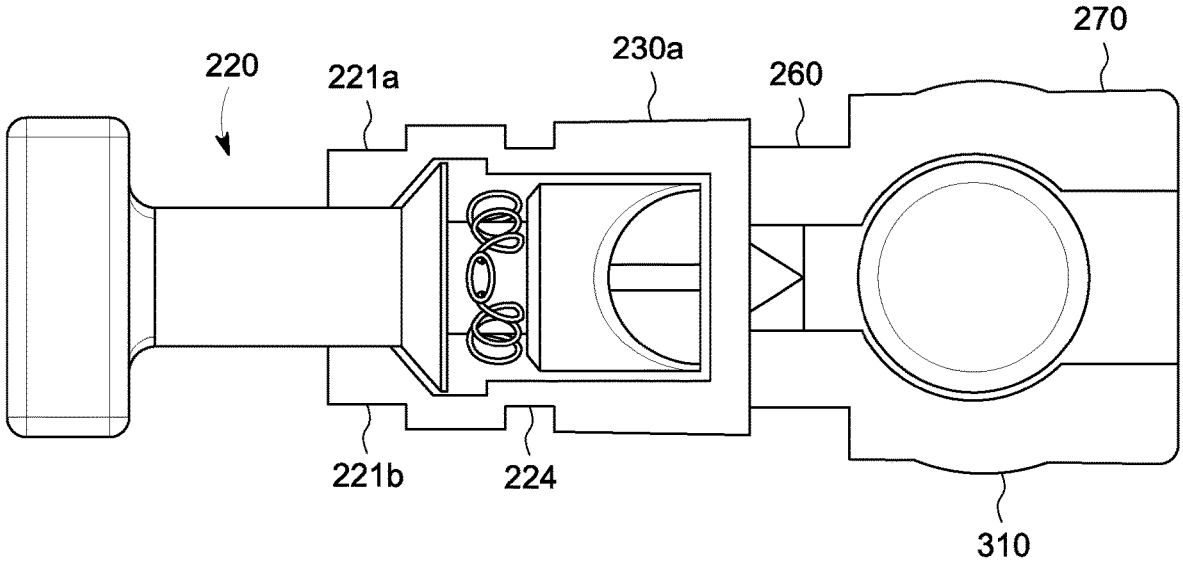
FIG. 3 is a first diagram of the assembled components (partially cut away) of FIG. 2.
Figure 5:
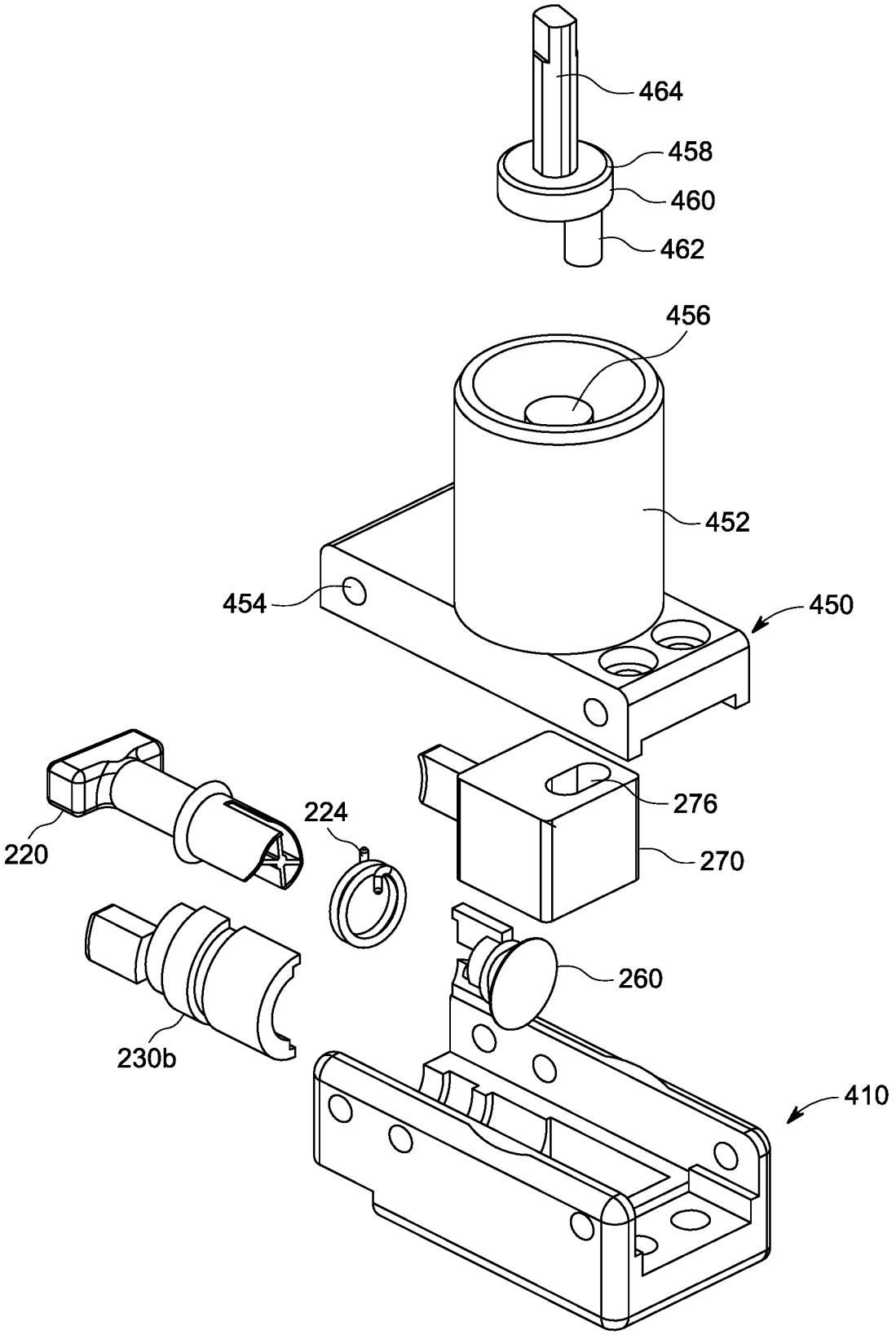
FIG. 5 shows the lock components of FIG. 4 with an upper housing portion that accommodates a cylindrical key.
Figure 6:
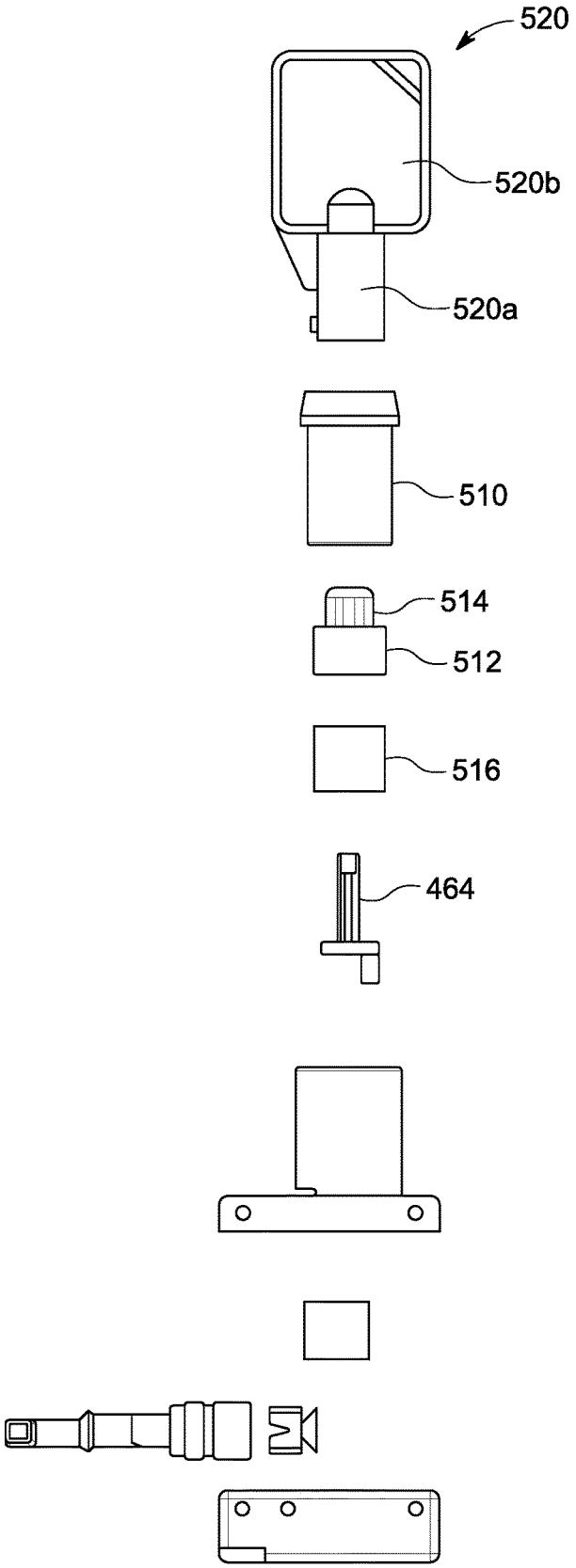
FIG. 6 is an exploded view of the keying components of the lock cylinder of FIG. 5.

Referring to the drawings, FIG. 2 shows (in exploded form) the key components of the internal elements of the locking cylinder which are assembled as shown in FIG. 3 and then placed inside a housing, including a bottom housing 410 and a top housing 450 (FIG. 5).

Figure 1B:
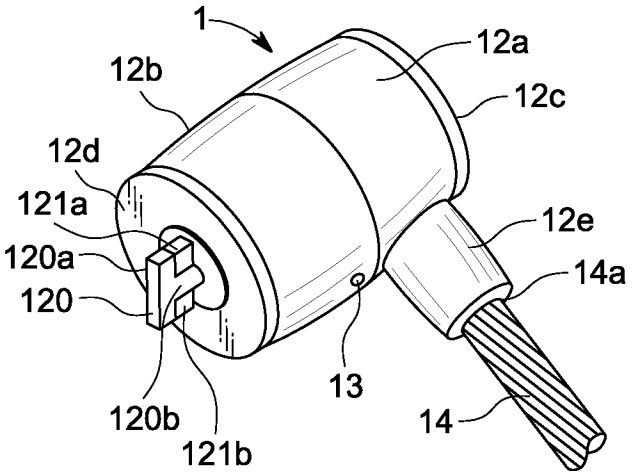
Prior Art FIG. 1b
FIGS. 1*a* and 1*b* show prior art locking systems for electronic devices.

Referring to FIG. 2, it is worthwhile to describe certain components by reference and comparison to the locking elements in FIG. 1*b* (prior art). Thus, FIG. 2 comprises a T-bar locking element 220 having a locking step 228 affixed to a rotating shaft 220*b*, which correspond, respectively, to the locking tab 128, the shaft 120*b* in prior art FIG. 1*b*.

The anti-rotation fingers or pins 121*a*, 121*b* in FIG. 1*b* are provided in FIG. 2 as anti-rotation fingers 221*a*, 221*b*, which are located, respectively, on half housing 230, including half housings 230*a*, 230*b*.

The T-bar shaft 220*b* has a centering annual wedge 222 which rotates inside the channel 232 in the half housings, with the spring 224 (on the shaft 220*b*) being located on the corresponding trough 236 in the half housings. The wedge 222 prevents axial movement of the shaft 220*b*.

At the rear of the shaft 220*b* is the camming portion 226 that has two curving camming surfaces 228*a*, 228*b* that function as explained immediately below. When the camming shaft 220*b* (and its included components) are sandwiched between the half housings 230*a*, 230*b*, space is left for the camming converter 260 to have its longitudinally extending upper and lower guides 264*a*, 264*b* to ride on the ledges, such as the ledge 238 in the half housing at the top and at the bottom with the camming converter 266 having its own counterformed and complementary camming surfaces 266*a*, 266*b* engaging respectively the camming surfaces 228*a*, 228*b*, in such a way that as the camming converter 266 is moved axially against the rear of the shaft 220*b*, it will cause the T-bar to rotate up to a maximum of 90°.

The retaining cone 262 on the camming converter 260 can be inserted through the bottom into the driving block 270, specifically into the cut-out 272 which is reachable through the opening 272*a* formed in the body of 274 of the cam driver 270.

When assembled together, and as also shown in FIG. 3, the two housing parts and the camming converter are rotationally fixed and can only rotate together relative to the driving block 270 via the coupling between the cone coupling 262 and the under cut cone-shaped opening 272. The T-bar locking element 220 is rotatable between the two housing halves in response to the camming driver 260 moving to the left or to the right in FIG. 3. The spring 224 has one end attached to the shaft 220*b* and the other end to one of the housing halves and is biased so that the orientation of the locking tab 220*a* is misaligned with the plane that holds the locking fingers 221*a*, 221*b*, i.e., to the locked position.

Figure 4:
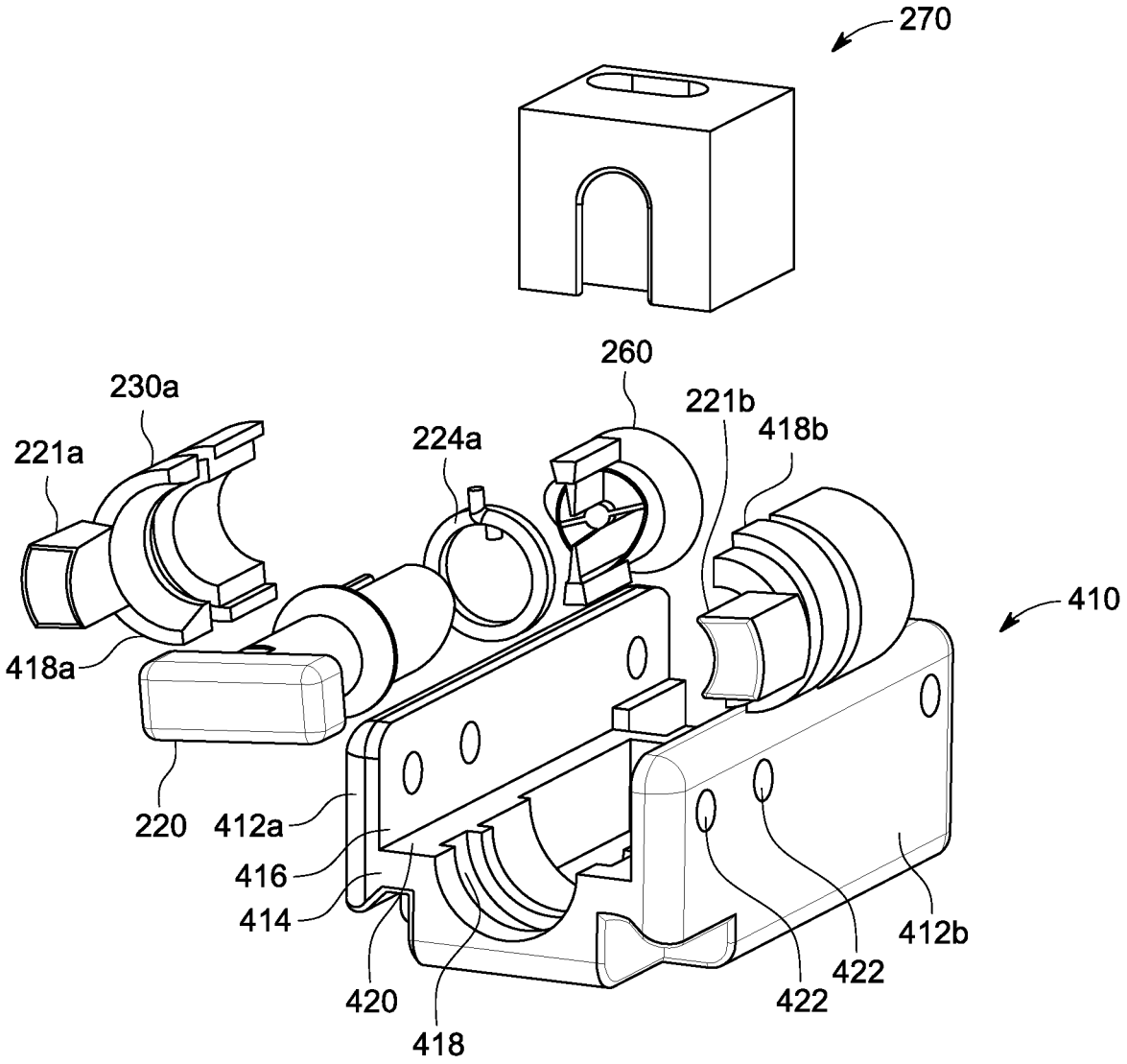
FIG. 4 is an exploded view of the components of FIG. 3, with a bottom housing.

For further elucidation, reference is now made to FIG. 4 showing a bottom outer housing 410 comprising left and right sidewalls 412*a*, 412*b* and a bottom housing wall 414 to define an interior space 416 that houses therein the previously described components, including the locking elements 220, the housing halves 230, the camming driver 260 and the cam driver 270. A channel 418 in the bottom wall 414 receives that annular projections 418*a*, 418*b* of the half housings 230*a*, and 230*b*, respectively.

The modified spring 224*a* has two protrusions; one to engage one of the half housings and the other the shaft of the locking element 220. The ledge 420 provided at the right and at the left a resting surface for the upper housing part 450 (FIG. 5). Regardless, the two housing halves 230*a*, 230*b*, can rotate between the bottom housing 410 and the upper housing/cover 450 while, as noted previously, the T-bar locking components are permitted to rotate between the housing halves, and being biased to the locked position (which would be a position of the locking tab 120*a* in FIG. 1*b* being rotated 90°. The openings 422 at the bottom housing enable pinning the two housing parts together via corresponding registered holes 454 in the upper housing part 450.

Referring now to FIG. 5, the upper housing 450 has a lock cylinder casing 452 defining an interior space 456 which receives a key operated key driver comprising a disc body 460 with a shaft 464 and an off center driving pin 462 comprising element 458. The finger heldable key handle 520*b* and the key 520*a* are well known in the art. The key 520 can only be inserted if it is properly keyed and thereby ultimately being useable to drive to open the T-bar to its unlocked position via rotation of the key shaft 464.

Figure 1A:
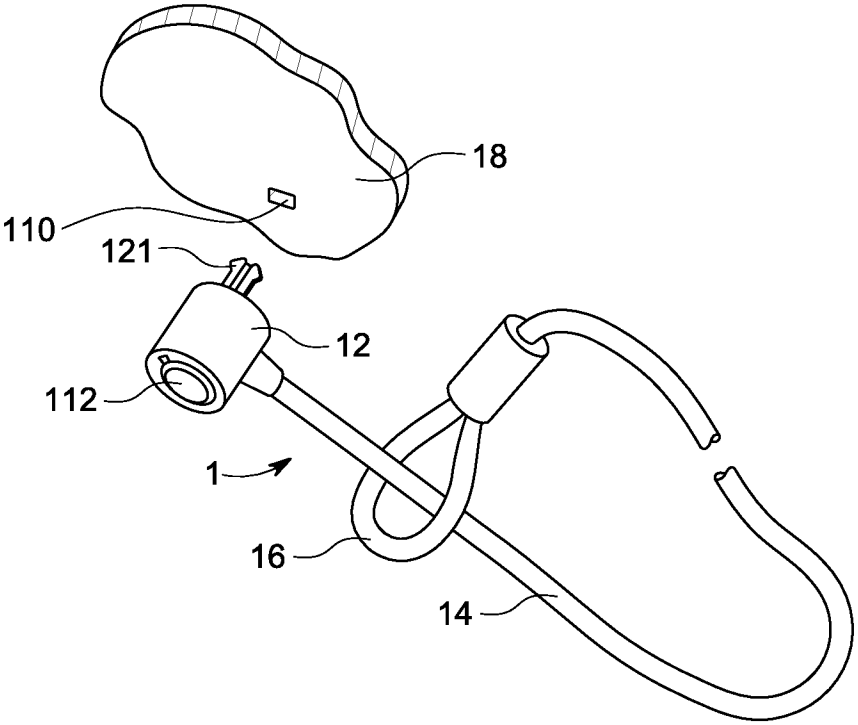
Prior Art FIG. 1a
Figure 7:
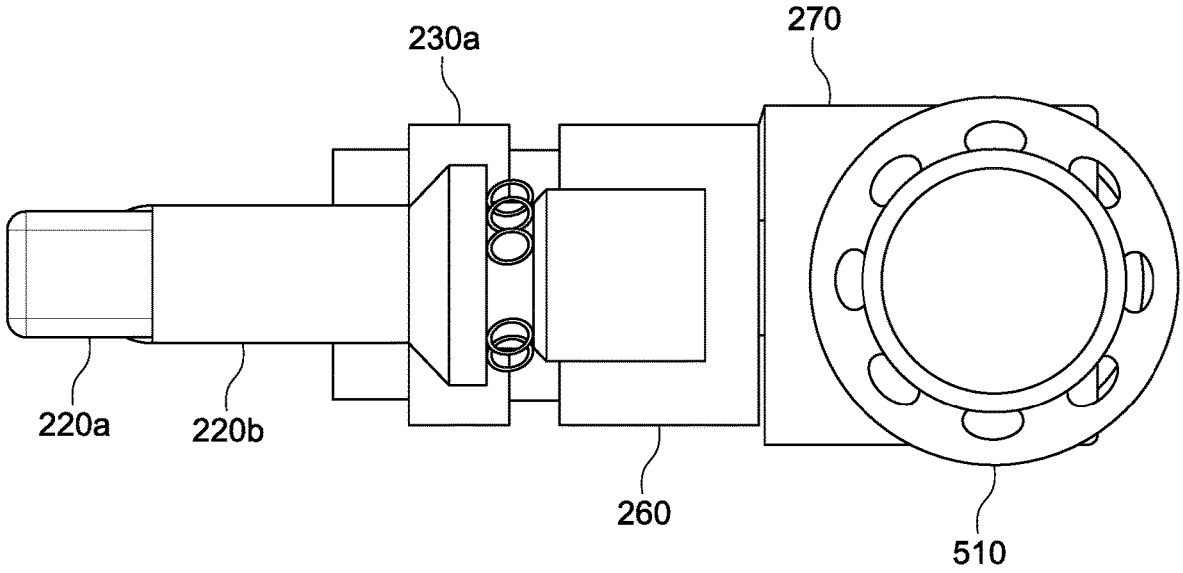
FIG. 7 shows the arrangement of FIG. 3 in a different locked position.

FIG. 7 is generally identical to FIG. 3, except that it shows the camming converter 260 pushed deeper onto the camming surfaces of the shaft, which causes the T-bar 228 to be aligned with the locking fingers to enable the T-bar to be inserted into (or withdrawn from) the security slot 110 (FIG. 1*a*).

Regardless, the aforementioned lock embodiment is such that in the assembled form thereof, the T-bar locking tab 220 in its locked position, reaches almost to the bottom of the housing part 414 and in its unlocked position, it is only on the order of about 3 mm or so above the table surface, which enables it to be inserted into a security slot 110 which is provided only approximately 3 mm over a table surface. This differs from the prior art (FIG. 1*b*) lock where in the opened position the security slot must be located not lower than about 10 mm from the table surface, in order to enable the cylinder 1 of FIG. 1*b* to be inserted into the security slot (without lifting the mobile device).

Figure 8:
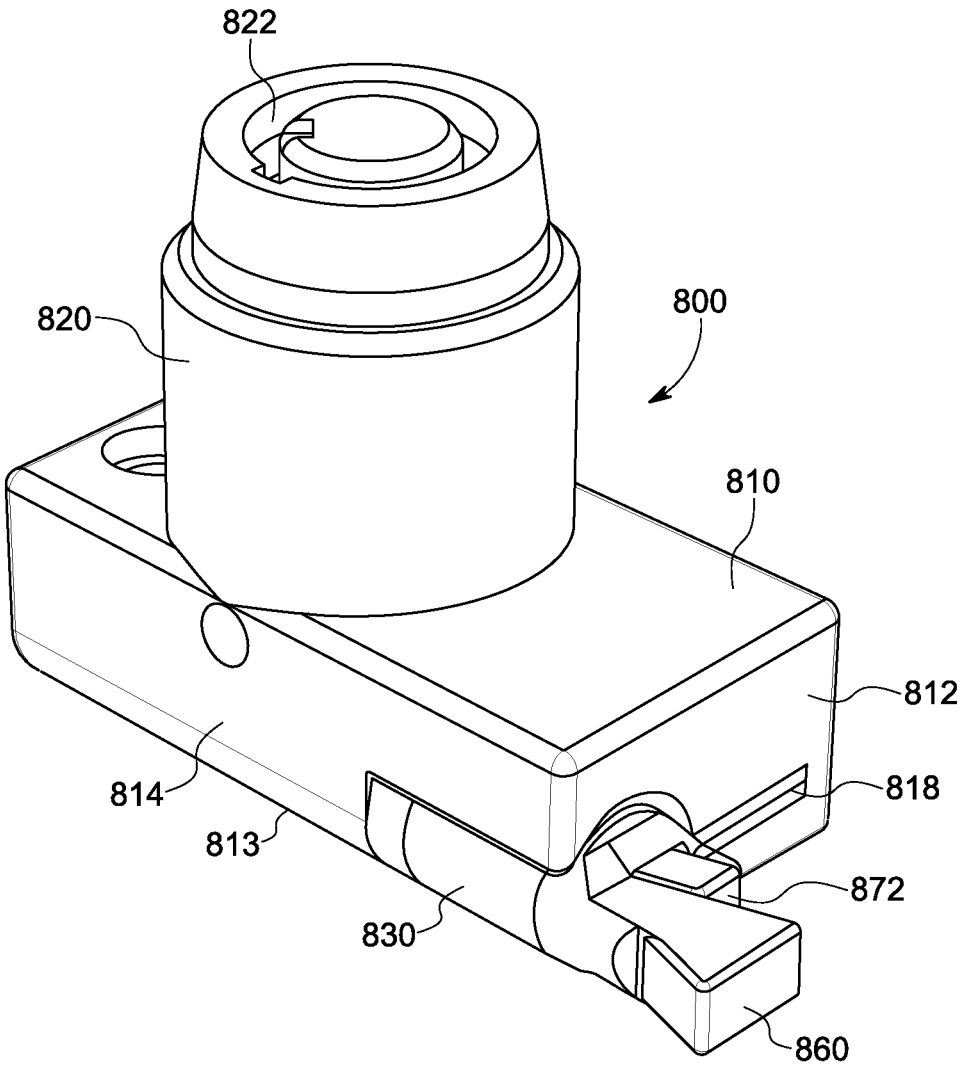
FIG. 8 is a perspective showing a variant placement of a locking head in a lock housing for a computer security system.
Figure 8A:
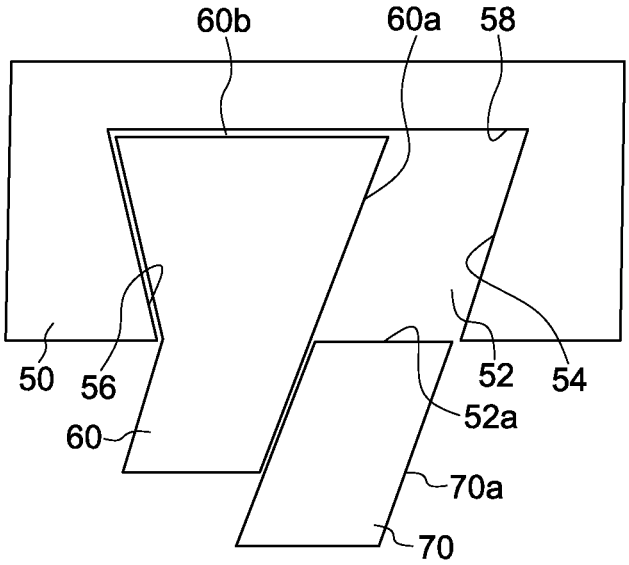
FIG. 8*a* is a diagram of the wedge slot operating with the wedge locking elements.
Figure 9:
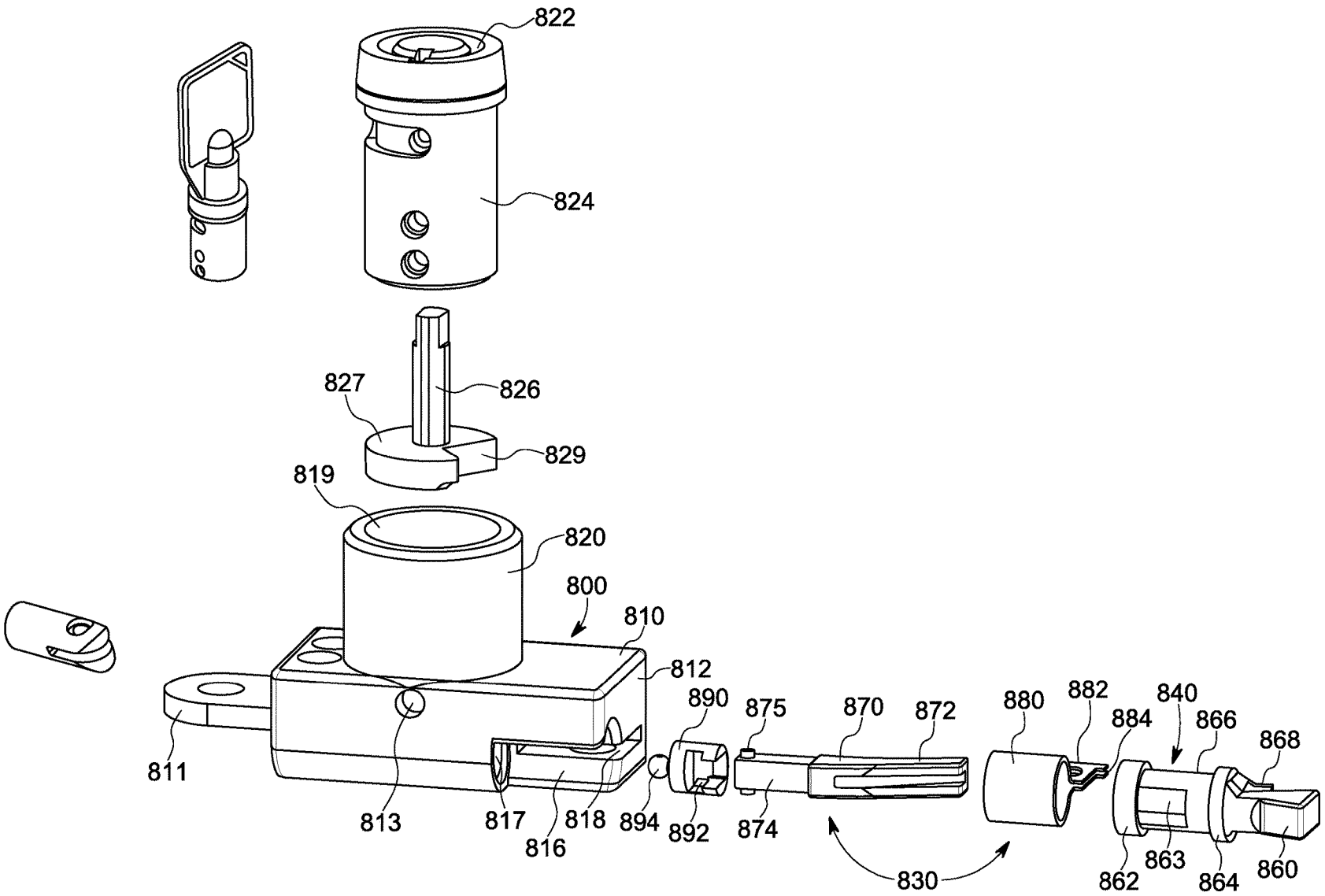
FIG. 9 is an exploded view showing interior components of the corner mounted locking head depicted in FIG. 8.

The embodiment of FIGS. 8 and 9 shows a variation on the concept of the invention, including, as shown in FIG. 8, a lock housing or body 800 at one corner of which housing is installed a lock head 830 comprising, inter alia, a main locking element 860 that, significantly, is wider at the front and which narrows in cross sectional size in the rear-wise direction and which operates with an accompanying slidable locking pin 870 (FIG. 9), the front section 872 of which is seen in FIG. 8. These locking elements 860 and 870 define the "wedge lock" referred to above, which has been in use in the prior art for several years now. The wedge lock is designed to lock within the Noble "wedge slot," all as explained in several prior art patents including in the instant inventor's, incorporated by reference, U.S. Pat. No. 9,137,911, with FIG. 8a herein being a prior art figure (FIG. 4) taken from the 9,137,911 patent to show and illustrate the locking principle employed by the wedge lock, which uses a concept similar to that of a "keystone" in Roman and Greek building arches.

The distinguishing feature in FIG. 8 is the location of the locking head 830 at one of the two bottom corners of the lock housing 830, where the front wall 812 and left side wall 814 meet. This enables the locking elements 860/870 to lie very close to the bottom surface 813 of the main body 810 of the lock 800, approximately with a spacing of only about 1 to 2 millimeters or so above the surface on which the housing 800 rests. With this arrangement, the locking elements can be inserted into a wedge slot, the center of which is only about 2 to 2.5 millimeters above the bottom of the computer device (not shown) containing the wedge slot, which is unheard of in the prior art of the present invention.

For some additional background, reference is made to prior art FIG. 8*a* herein which depicts a wedge slot 50 with an interior 52 defined by non-parallel and diverging side walls 54/56, into which are inserted a main lock element 60 having a wide front 60*b* with a slanted side wall 60*a*, along which can be inserted the locking pin 70 that slides along the wall 60*a*, filling the cavity space 52 left unoccupied by the locking element 60, leaving only a small space to the front wall 58 of the wedge slot, all as fully described in the 9,137,911 patent.

In FIG. 8, the housing 800 includes a circular cut out 816 (FIG. 9) and a thin channel 818 accessible at the front wall 812, for receiving and holding a portion of the lock head assembly 830 as explicated later. Also note the circular housing portion 820 that is designed to hold the key operated lock cylinder/mechanism 822.

Figure 12:
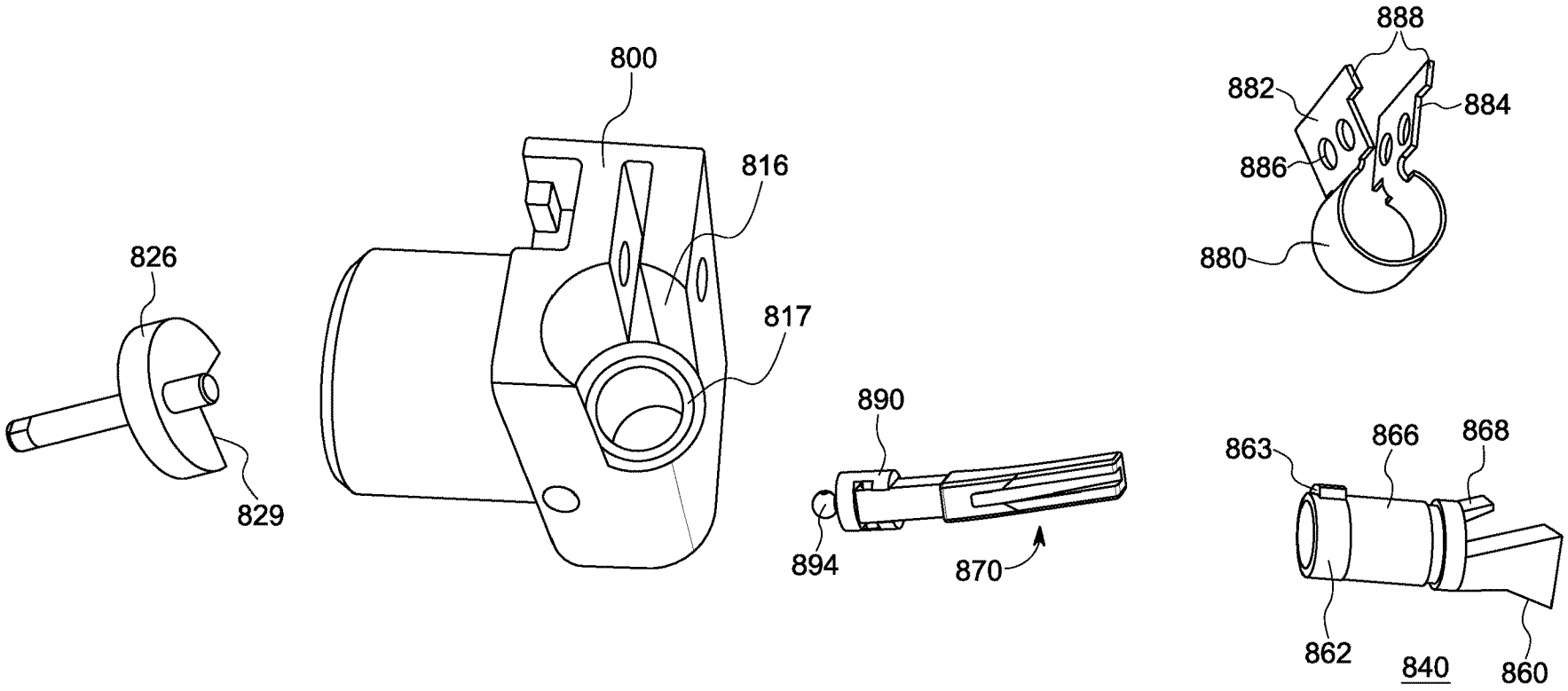
FIG. 12 shows photographically components of the lock of FIG. 8 in an exploded view.

FIG. 9 depicts, in exploded view, the details of the locking head 830 and the manner in which its components are inter-assembled and firmly held to and secured within the interior of the housing body 810. From right to left in the figure, the main wedge cavity engaging components include the cylindrical front body 840 with a rear ring 862, front ring 864, defining therebetween a circular detent 866. The main locking element 860, generally triangularly-shaped as in FIG. 12, extends forwardly, from one side of the body 840, gradually increasing in cross-sectional size, so it is widest at the front, as best seen in FIG. 12. The construction leaves an open channel 863 that begins at the left side of the body 860, extends through the body 840 and emerges at the front side bounded (partially) by the main locking element 860 and the guide pin 868.

Figure 13:
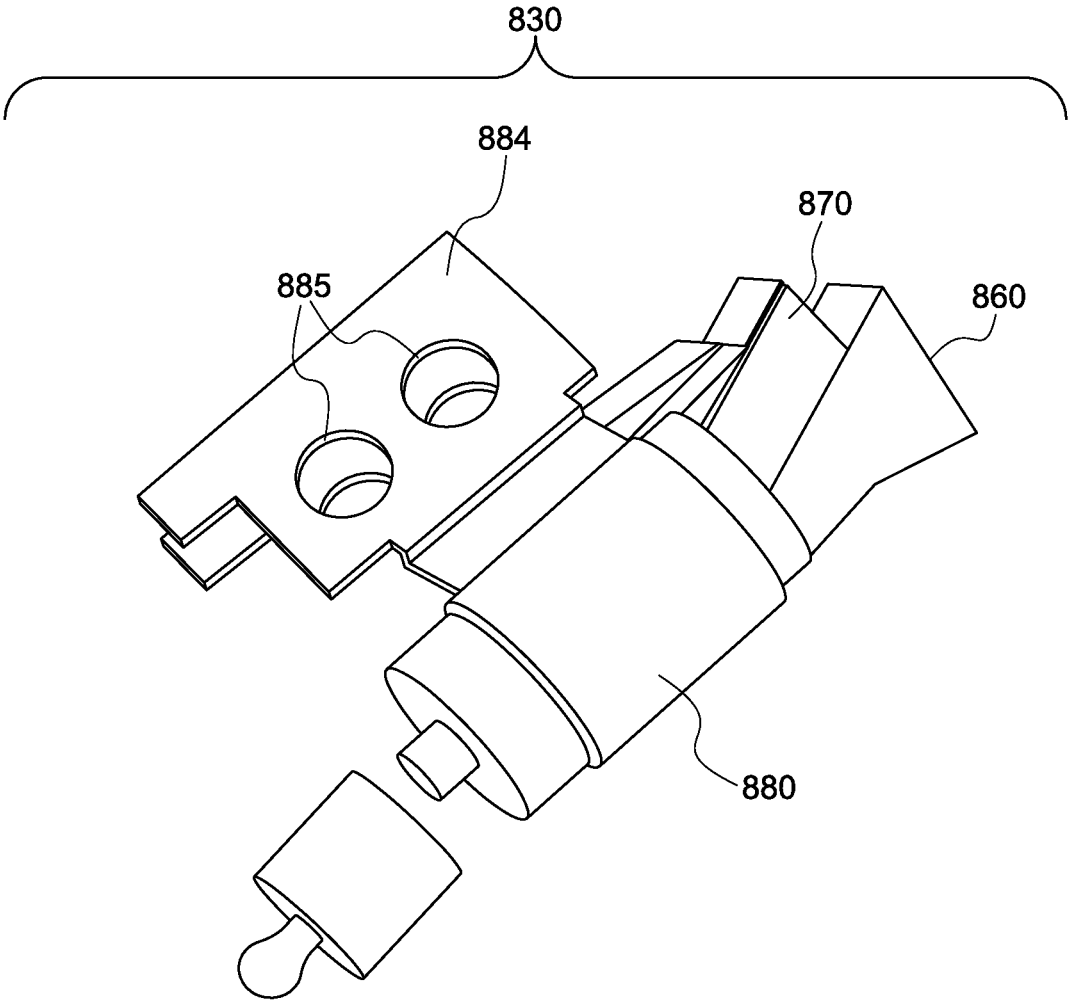
FIG. 13 shows partially assembled components of the locking elements shown in FIG. 12.

The retainer 880 in FIGS. 9 and 12 is constructed of very thin metal that is bent into a cylindrical shape, terminating in tabs 882 and 884 that are perforated to define rivet holes 886 and provided with anti-bending jutting fingers 888. The thickness of the metal is closely matched to the depth of the detent 866, so when the retainer 880 is wrapped around the detent 866 the outer surfaces of the retainer 880, and the rings 862 and 864 are merged into a continuous comparatively smooth single surface of a given diametrical size. See FIG. 13. The retainer is used to anchor the body 840 in the housing body 810 by using rivets (not shown) passing through both the housing body 810 and the tab holes 886 of the retainer 880. The construction allows the body 840 to rotate in the retainer 880, and relative to the main lock housing 800. Although, the retainer has a body thickness of about or even less than a single millimeter, since it fits very tightly in the housing body 810, it will not become crushed or twisted and is able to withstand pulling forces of well over 150 pounds.

The assembly 830 is further defined by the slidable locking pin 870 being inserted, front section 872 first, into the channel 863, the front section 873 passing through and emerging between the main locking element 860 and the guiding pin 868. See FIG. 13.

The locking concept for the wedge lock requires enabling the front section 872 of the locking pin to be slid out to lie adjacent to the main locking element 860, in the locked position, or to be withdrawn into the body 840, in the unlocked position which makes it possible to insert and withdraw the main locking element 860 (the front width of which is approximately that of the opening into the wedge cavity/slot 50 referred to in FIG. 8*a*), when it is desired to either attach or dis-attach the lock of the present invention to or from the wedge slot. One cannot simultaneously insert into the cavity 50 (FIG. 8*a*) both locking elements 860/870, because the front most dimension of the main locking element 860 is about that of the (rectangular) opening into the cavity 50.

The ability to drive/slide the locking pin 870 is provided by the driver block 890, which has a circular shape in the present embodiment with a diameter matched to that of the ring 864. The driver block has an opening 892 shaped to receive and hold within the extension 874 of the pin 870 holding it by its ears 875. At the opposed end, the holding ball 894 fits within a hole (not shown) inside the main body housing 810, at a location therein that allows it to be moved/slid, front to back and vice versa relative to the main housing 800, by the lock driver 826, specifically its disk 827, that engages the ball 894 by passing into the housing via the lock housing 820.

The rod 821 can turn over a limited angle defined by the cutout 829 in the disk 827, by the disk 827 being engaged by locking cylinder 824 that is turned by a key (not shown, but very well known) that is inserted into the cylinder at 822. The locking driver is fixed to the housing by a rivet inserted through the hole 813. As is widely known in this art, a cable with a loop at the free end of the cable (not shown) can be connected to the housing 800 via many different means including via the cable tab 811 shown in FIG. 9.

Figure 14:
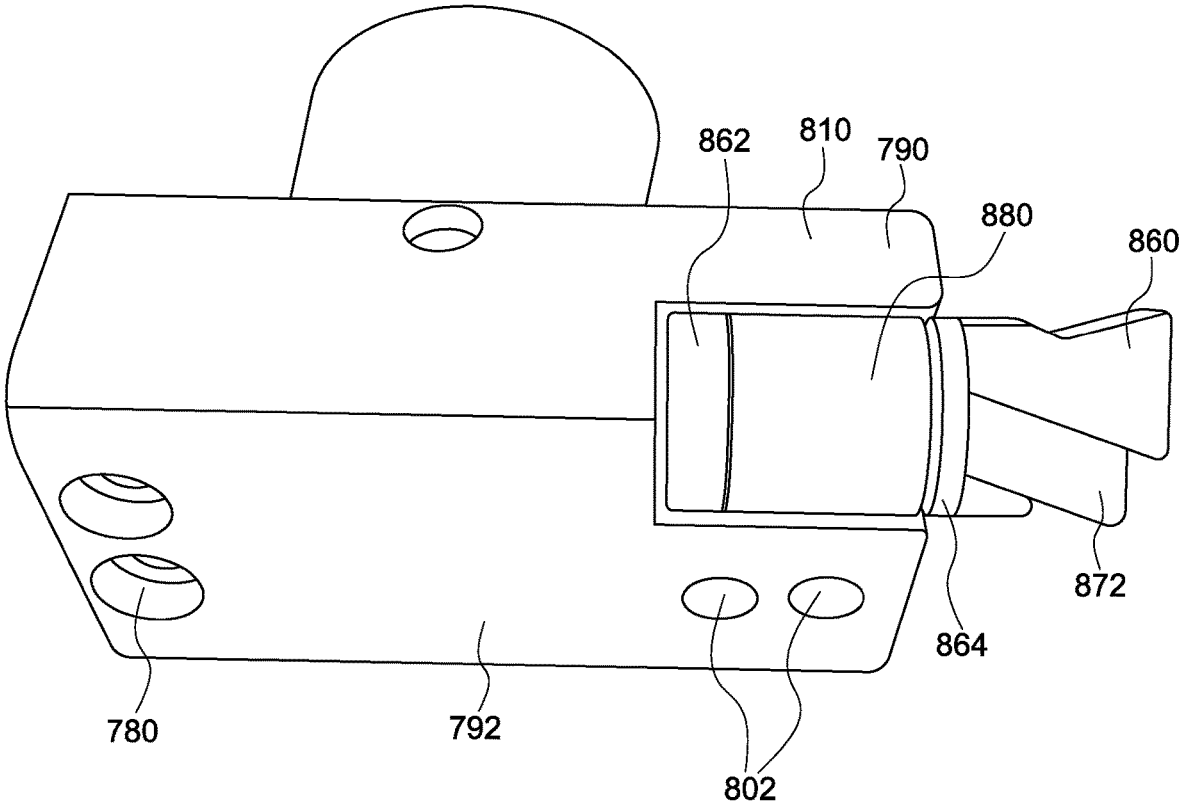
FIG. 14 shows a further assembled photo of the lock of FIG. 12.

The main housing body 810 includes, as mentioned, the cylindrical cutout 816 which continues into the circular tunnel 817 which is deep enough to register with the opening 819 into the lock mechanism housing 820. See FIG. 12. The tabs 882/884 of the retainer are fitted very tightly into the narrow ridge 881, with the fingers 888 thereof reaching into a tight fitting hole (not shown) and helping to prevent withdrawal and twisting of the assembly 830. Therefore, when the assembly 830 (FIG. 13) is partially inserted into the tunnel 817 (FIG. 14) and fixed therein with rivets inserted in the holes 802, the assembly becomes firmly affixed to the body 810, including owing to the cylindrical opening 816 wrapping the assembly over more than 180 degrees, preferably close to 270 degrees, of its cylindrical outer body, which prevents its being pulled out or twisted out by sideways forces of the space 816/817 of the housing body 810.

The manner in which the assembly 830 is fixed to the housing body 810 permits however the locking elements 860/872 to rotate relative to the housing 810, which provides a significant operational advantage as explicated later. But even more importantly, the outer surfaces of the ring 862, the retainer 880 and the ring 864 lie literally flush (even) with the outer bottom and side surfaces, 792 and 790 respectively, of the housing body 810, which also locates the locking elements 860/872 to be almost at the location of the surfaces 792/790. This is very significant, for if the locking wedge slot is located on a laptop or tablet or the like very close to the bottom surface, on the order of a millimeter or so, the locking elements 860/870 are still able to be inserted into the security slot, without the lock housing 800 lifting, undesirably, the tablet off the surface on which it is resting.

Figure 10:
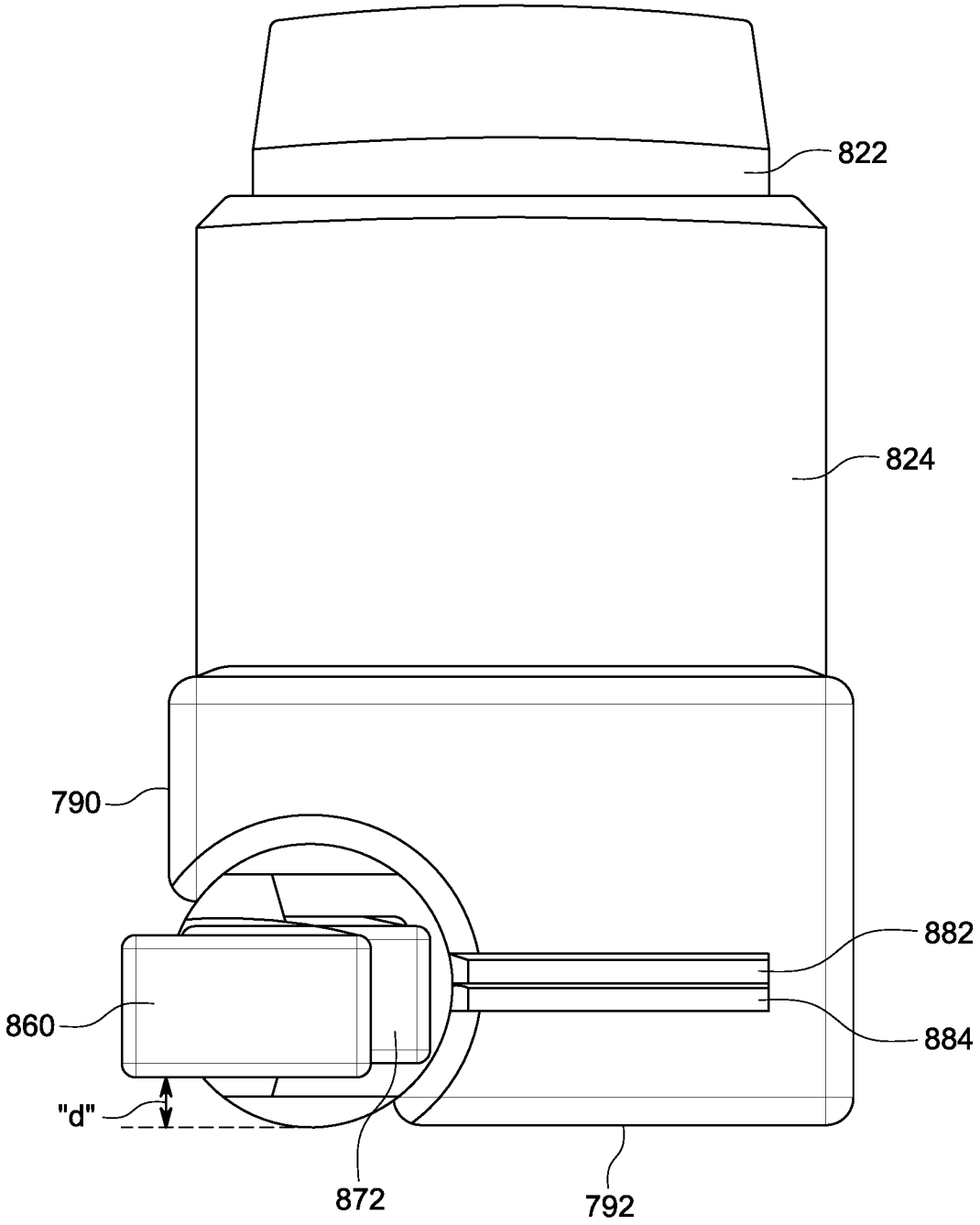
FIG. 10 shows a plan, front view of the lock of FIG. 8.

Another advantage provided by the lock design of FIGS. 8 and 9 is that the lock housing 800 can be positioned, in use, so it lies on its bottom side 792 or on its side wall 790, to suit different lock position preferences or requirements, for example to obtain a smaller foot print since the side wall is narrower (smaller) as compared to that of the bottom side, as seen in FIG. 10. In an embodiment that has been reduced to practice, the distance "d" in FIG. 10 is about 1.88 mm, the side to side width is about 12 mm, the height is about 7.9 mm and the front to back size is about 26 mm. Yet, the holding strength of the lock head 800 in the wedge slot 50 (FIG. 8*a*) is such, that it is able to resist pulling forces that well exceed the standard test pulling force of 150 pounds, which is truly astounding for a lock having locking elements that are about 2 millimeter sized.

A further significant benefit ensues from the overall housing rotating about the locking elements 860 and 870. Thus, unlike many available locks for computer security, the lock of the present invention cannot be broken by applying turning and twisting forces to the housing while its locking elements are secured in the locking wedge slot. And as noted above, it is very difficult to defeat the lock by attempting to pull it out of the wedge slot, as more likely this will break the computer rather than the lock.

Figure 11:
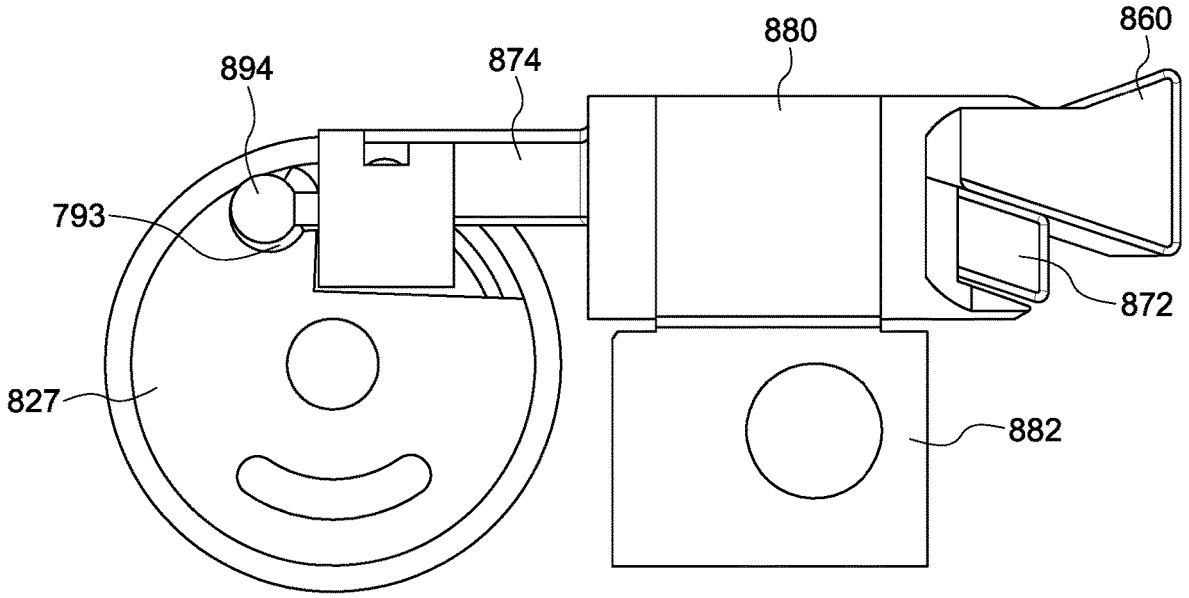
FIG. 11 shows a diagrammatical explanation of the lock of FIG. 8.
Figure 15:
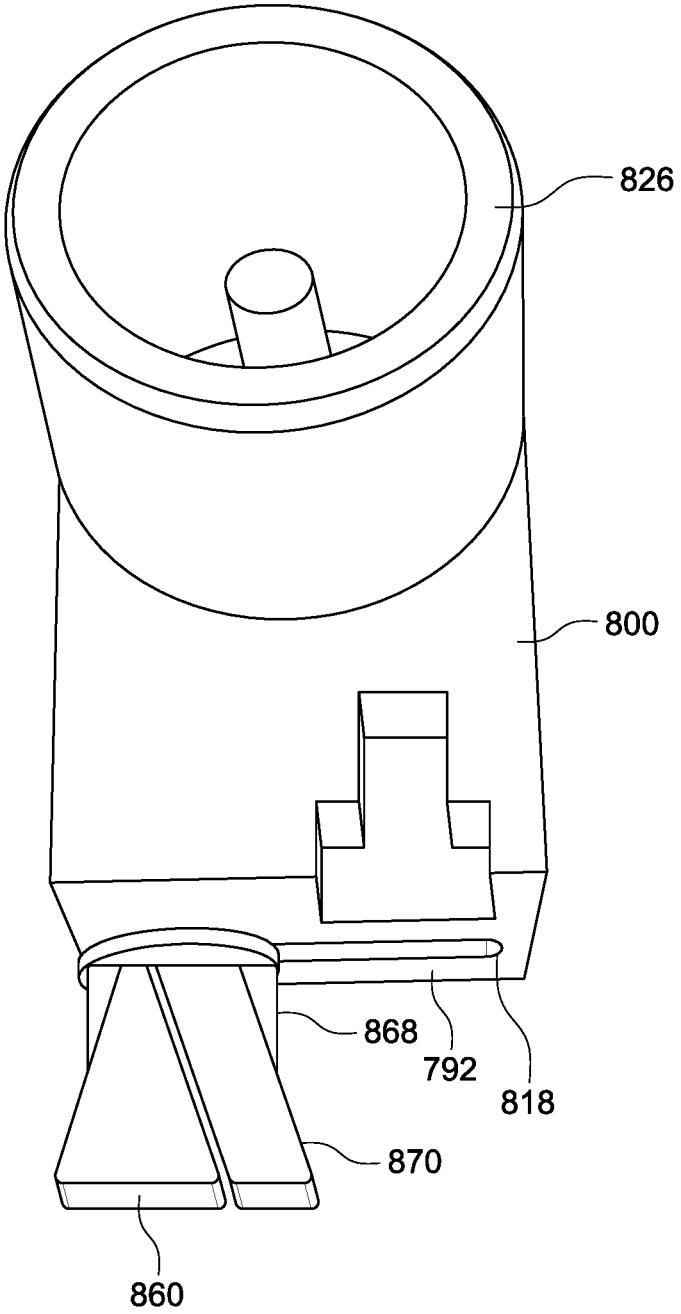
FIG. 15 shows the lock of FIG. 12 from a different angle.

With reference to FIG. 11, note that the ball 894 of the driver 890 sits in a well 793 defined in the bottom surface of the disk 827. As the disk 827 is turned, it pushes the locking pin section 872 out alongside the main locking element, guided by a tongue/groove arrangement provided between the locking elements, when the disk 827 is turned in one direction, or is pulled inside when the disk 827 is turned in the other direction. The locking elements 860/870 are depicted in FIG. 15 showing the housing 800 resting on its (wider) bottom surface 792. Also note that in the locked position in FIG. 15, the locking elements positioned abutting each other define together a general triangle shape that substantially fills the cavity 50 resting against the side walls of the cavity 50 and making it impossible to being withdrawn from the cavity except by breaking the walls of the cavity or the locking elements.

Figure 16:
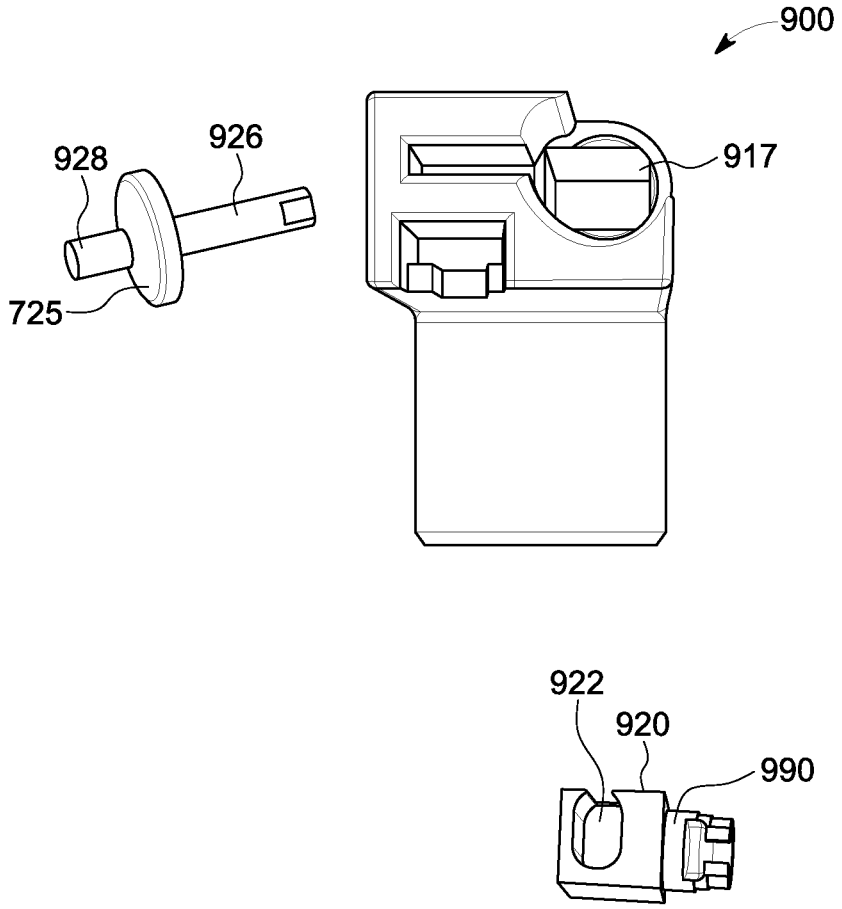
FIG. 16 shows a slightly modified version of the lock of FIG. 12.
Figure 17:
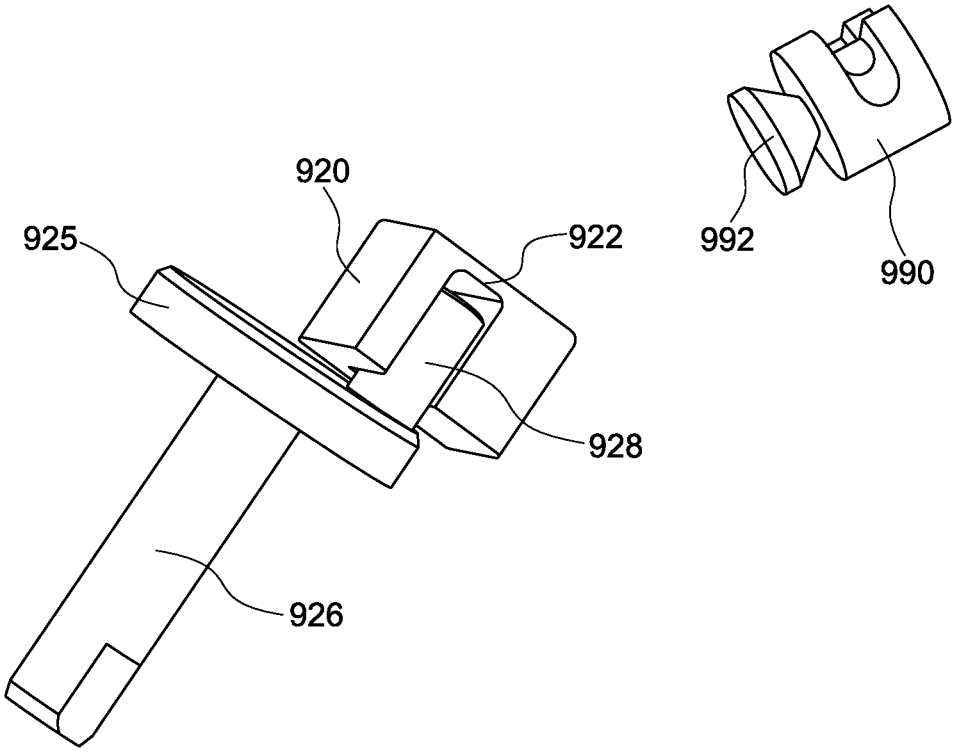
FIG. 17 shows components associated with the lock of FIG. 16.

FIGS. 16 and 17 present a minor variation to the above described corner-mounted lock construction, in which the channel 917 into the lock housing 900 is rectangular (rather than circular) enabling it to receive the pin driver 920, which is rectangular in cross section, and drive it forward or pull it backward (pushing/pulling the locking pin 870) by having an eccentrically located key pin 928 of the disk 927 travel within the cutout 922. Otherwise, the operation and benefits of this embodiment are virtually identical to those described above.

Figure 18:
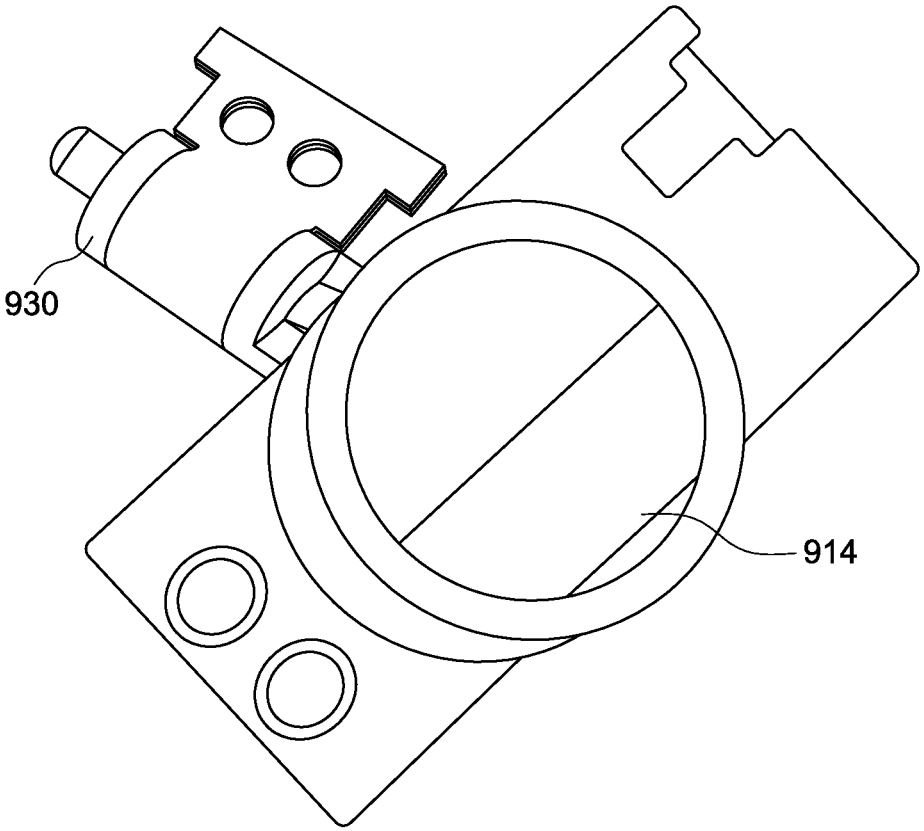
FIG. 18 shows an interior feature of the lock of FIG. 16.

FIG. 18 illustrates an interior rectangular guide channel 914 for the pin driver. Also, while the invention has been generally described as placing the cable tab 811 at the rear and the locking mechanism at the top, the placement of these components can be reversed, to accommodate certain computer designs, if desired. Further, the design permits the locking elements assembly to be placed between the bottom corners of the housing 800. Still further, while the locking elements 860/870 are described above, the concept of the invention provides for the use of two main locking elements having slanted surfaces and the locking elements being able to be pushed away from each other, by a pin that is linearly moved therebetween or by a "cammed" non-circular, preferably rectangular pin that rotates between two positions to cause the pair of main locking elements to move apart, as described in the inventor's incorporated by reference patents.

It is implicit in the description that the locking mechanism can be implemented to use either a key or a combination lock or even an electronically operated lock that is actuated into the locked or unlocked position by signals received from one's mobile phone or the like. Furthermore, while the locking elements are shown mounted at one of the corners, they can be easily moved toward the center, for example so as to be located midway between the sidewalls of the housing 800, but still within a millimeter or so of the bottom wall surface of the housing 800 as described above.

One of skill in the art would readily appreciate that the objective of the present invention can be realized by lock that has an overall cylindrical shape, with a front wall at one end of the cylinder, by locating the locking element assembly off center relative to the longitudinal axis of the cylinder, adjacent the outer cylindrical wall.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A lock for computer security, the lock comprising:

a housing comprising a bottom wall, at least one side wall and a front wall with a corner defined where the front wall and the at least one side wall meet each other;

a locking assembly comprising a locking assembly body holding at least two locking elements including at least one first locking element and a second movable locking element, both said locking elements being supported by the locking assembly body, and the first locking element extending from and away from the locking assembly body at the front wall of the lock housing;

a driver coupled to the movable locking element and configured to selectively move the movable locking element between a locked position and an unlocked position;

a locking mechanism supported by the housing, coupled to the driver and configured to actuate the driver to move the movable locking element between said locked position and said unlocked position; and the locking assembly being secured to and partially passing through the housing at the corner thereof, with the locking elements located directly adjacent both the bottom wall and the at least one side wall.

2. The lock of claim 1, wherein the first locking element and the movable locking element, when located adjacent to each other, define a substantially triangle-shape structure.

3. The lock of claim 1, wherein the housing has a cutout at the corner, at the location of the locking assembly body.

4. The lock of claim 3, wherein the housing surrounds the locking assembly body at the cutout over more than 180° portion of a circumference associated with the locking assembly body.

5. The lock of claim 1, including a retainer made of thin metallic sheet metal that wraps around the locking assembly body and is configured to secure the locking assembly body to the housing by affixing the retainer to the housing.

6. The lock of claim 5, wherein the thickness of the metallic sheet is less than 1 mm.

7. The lock of claim 1, wherein the movable locking element is slideable within a channel formed in the locking assembly body and the movable locking element is mechanically coupled to a driver that is configured to move the movable locking element in the channel formed in the locking assembly body.

8. The lock of claim 7, further including a locking mechanism that is coupled to driver and which is configured to lock the movable locking element in a locked state thereof, at which the movable locking element is positioned alongside the first locking element.

9. The lock of claim 1, further including a cable mechanically coupled to the housing, by which the lock can be tethered to an immovable object.

10. The lock of claim 5, wherein the retainer has a pair of overlapping tabs and the tabs are physically connected to the housing.

11. The lock of claim 10, wherein the retainer is wrapped around the locking assembly body in a manner that enables the locking assembly body to rotate relative to the retainer and relative to the housing.

12. The lock of claim 1, wherein the driver has a circular cross-section and including a circular channel in the housing for enabling the driver to slide back and forth therein.

13. The lock of claim 1, wherein the driver has a rectangular cross-section and including a rectangular channel in the housing for enabling the driver to slide back and forth therein.

14. The lock of claim 1, wherein the first locking element and the movable locking element, when located alongside each other, can be oriented to lie parallel to a bottom horizontal plane passing through bottom surfaces of the locking elements and the plane is located within 2 mm of a flat resting surface on which the housing is located.

15. The lock of claim 1, wherein the housing has a rectangular cross-section defined in part by the bottom wall and by the at least one side wall.

16. The lock of claim 1, wherein the housing is rectangular and has a height dimension and a width dimension, less than 8 mm and 13 mm, respectively.

17. The lock of claim 14, wherein a height of the horizontal plane remains the same regardless of whether the housing is placed on the resting surface with its bottom side or its at least one side wall contacting the resting surface.

18. The lock of claim 1, wherein one of the locking elements has a T-bar shape.

* * * * *